US011430621B2

(12) United States Patent
Lee

(10) Patent No.: US 11,430,621 B2
(45) Date of Patent: Aug. 30, 2022

(54) DC CIRCUIT BREAKER

(71) Applicant: LS ELECTRIC CO., LTD., Anyang-si (KR)

(72) Inventor: Sangchul Lee, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 16/954,851

(22) PCT Filed: Nov. 12, 2018

(86) PCT No.: PCT/KR2018/013713

§ 371 (c)(1),
(2) Date: Jun. 17, 2020

(87) PCT Pub. No.: WO2019/132237

PCT Pub. Date: Jul. 4, 2019

(65) Prior Publication Data

US 2021/0090829 A1 Mar. 25, 2021

(30) Foreign Application Priority Data

Dec. 27, 2017 (KR) ..... 10-2017-0181337

(51) Int. Cl.
*H01H 33/02* (2006.01)
*H01H 33/18* (2006.01)

(52) U.S. Cl.
CPC ..... *H01H 33/18* (2013.01); *H01H 33/025* (2013.01)

(58) Field of Classification Search
CPC ..... H01H 9/36; H01H 9/40; H01H 33/18; H01H 33/025; H01H 33/59; H01H 33/596;
(Continued)

(56) References Cited

U.S. PATENT DOCUMENTS 4,051,334 A * 9/1977 Ericson ..... H02B 11/133 200/50.26
6,034,861 A * 3/2000 Meiners ..... H01H 71/08 335/8
(Continued)

FOREIGN PATENT DOCUMENTS

CN 201213204 Y 3/2009
CN 101740274 A 6/2010
(Continued)

OTHER PUBLICATIONS

International Search Report for related International Application No. PCT/KR2018/013713; dated Jul. 4, 2019; (5 pages).
(Continued)

*Primary Examiner* — William A Bolton
(74) *Attorney, Agent, or Firm* — K&L Gates LLP

(57) ABSTRACT

A DC circuit breaker according to various embodiments may comprise: a first terminal unit connected to a power source; and a second terminal unit connected to the first terminal unit and connected to a load, wherein the first terminal unit includes at least a pair of first terminals connected to each other in parallel and connected to the power source, and the second terminal unit includes at least a pair of second terminals corresponding respectively to the first terminals and connected to each other in parallel so as to be connected to the load.

8 Claims, 8 Drawing Sheets

(58) Field of Classification Search
CPC ..... H01H 9/54; H01H 9/342; H01H 9/345; H01H 9/346; H01H 71/10; H01H 71/08; H01H 71/18; H01H 2071/088; H01H 73/20; H01H 33/10; H01H 9/542; H01H 9/547; H01H 33/04; H01H 33/14; H01H 71/082; H01H 71/1045; H02B 11/04
USPC ..... 218/18, 22
See application file for complete search history.

(56) References Cited

U.S. PATENT DOCUMENTS

| | | | | |
|---|---|---|---|---|
| 6,337,613 | B1 * | 1/2002 | Grelier | H01H 9/0072 335/6 |
| 6,563,406 | B2 * | 5/2003 | Beatty | H01H 71/1045 335/147 |
| 8,123,553 | B2 * | 2/2012 | Lyu | H01H 1/5833 439/566 |
| 8,390,406 | B2 * | 3/2013 | An | H01H 9/362 335/157 |
| 8,772,665 | B2 * | 7/2014 | An | H01H 9/346 218/34 |
| 9,779,903 | B2 * | 10/2017 | Nereau | H01H 71/52 |
| 2010/0126966 | A1 | 5/2010 | Domejean et al. | |
| 2012/0138442 | A1 | 6/2012 | Beatty | |
| 2015/0062769 | A1 | 3/2015 | Cortes Rico | |
| 2016/0079024 | A1 | 3/2016 | Nereau | |
| 2017/0110858 | A1 * | 4/2017 | Kosyanchuk | H02B 1/21 |
| 2018/0138670 | A1 * | 5/2018 | Pellegrini | H02B 11/04 |

FOREIGN PATENT DOCUMENTS

| | | | |
|---|---|---|---|
| CN | 203085442 | U | 7/2013 |
| CN | 203397966 | U | 1/2014 |
| CN | 204215989 | U | 3/2015 |
| CN | 204834484 | U | 12/2015 |
| CN | 105261502 | A | 1/2016 |
| CN | 105428168 | A | 3/2016 |
| CN | 205789789 | U | 12/2016 |
| CN | 107331569 | A | 11/2017 |
| EP | 0702387 | A1 | 3/1996 |
| JP | 2012138173 | A | 7/2012 |
| JP | 2012174686 | A | 9/2012 |
| JP | 2012221701 | A | 11/2012 |
| JP | 2012248445 | A | 12/2012 |
| JP | 2015220180 | A | 12/2015 |
| JP | 2017010706 | A | 1/2017 |
| KR | 20150040490 | A | 4/2015 |
| KR | 101733276 | B1 | 5/2017 |
| KR | 20170108657 | A | 9/2017 |
| WO | 2013171903 | A1 | 11/2013 |
| WO | 2017198165 | A1 | 11/2017 |

OTHER PUBLICATIONS

Written Opinion for related International Application No. PCT/KR2018/013713; dated Jul. 4, 2019; (3 pages).
Korean Office Action for related Korean Application No. 10-2017-0181337; dated Nov. 26, 2019; (3 pages).
Extended European Search Report for related European Application No. 18897036.2; dated Aug. 2, 2021; (12 pages).
Japanese Office Action for related Japanese Application No. 2020-535082; dated Jul. 13, 2021; (3 pages).
Chinese Office Action for related Chinese Application No. 201880083899.4; dated Dec. 9, 2021; (7 pages).

* cited by examiner

DC CIRCUIT BREAKER

CROSS-REFERENCE TO RELATED APPLICATIONS

This application is the National Stage filing under 35 U.S.C. 371 of International Application No. PCT/KR2018/013713, filed on Nov. 12, 2018, which claims the benefit of earlier filing date and right of priority to Korean Application No. 10-2017-0181337, filed on Dec. 27, 2017, the contents of which are all hereby incorporated by reference herein in their entirety.

FIELD OF THE INVENTION

Various embodiments relate to a large-capacity DC circuit breaker.

BACKGROUND OF THE INVENTION

A circuit breaker is installed between a power source and a load to open and close a circuit. That is, the circuit breaker detects a fault current in the circuit and block the circuit, thereby protecting facilities and human lives. Recently, as a renewable energy business is growing, a usage of direct current (DC) system is gradually increasing. Accordingly, the circuit breaker used in an alternating current (AC) system is now used in the DC system with a simple change. For example, the breaker used in the DC system may include power terminals configured to be connected to a power source and load terminals configured to be connected to a load. In this case, as the power terminals and load terminals are connected in series, the breaker can be used in the DC system.

However, the circuit breaker as described above has a problem in that a conduction capacity thereof is low. That is, the circuit breaker cannot pass a large amount of DC power.

BRIEF SUMMARY OF THE INVENTION

The DC circuit breaker according to various embodiments may have an improved conduction capacity. That is, the DC circuit breaker can pass a large amount of DC power.

A DC circuit breaker according to various embodiments may include a first terminal unit connected to a power source, and a second terminal unit connected to the first terminal unit and connected to a load.

According to various embodiments, the first terminal unit may include at least a pair of first terminals connected to each other in parallel and connected to the power source.

According to various embodiments, the first terminal unit may further include a first connection portion configured to connect the first terminals in parallel.

According to various embodiments, the second terminal unit may include at least a pair of second terminals respectively corresponding to the first terminals and connected to each other in parallel so as to be connected to the load.

According to various embodiments, the second terminal unit may further include a second connection portion configured to connect the second terminals in parallel.

According to various embodiments, the first terminals may include a pair of first positive terminals configured to be connected to a positive electrode of the power source, and a pair of first negative terminals configured to be connected to a negative electrode of the power source.

According to various embodiments, the second terminals may include a pair of second positive terminals respectively corresponding to the first positive terminals, and a pair of second negative terminals respectively corresponding to the first negative terminals.

According to various embodiments, the DC circuit breaker may further include an opening and closing portion configured to control the connection between the first terminal unit and the second terminal unit.

According to various embodiments, the DC circuit breaker may include an arc-extinguishing portion configured to extinguish an arc generated by an operation of the opening and closing portion.

According to various embodiments, the arc-extinguishing portion may include an induction portion configured to guide the arc generated by the operation of the opening and closing portion to a grid portion, the grid portion configured to increase a pressure of the arc induced by the induction portion, and an exhaust portion configured to discharge the arc having the increased pressure through the grid portion.

According to various embodiments, the DC circuit breaker may include a supporting portion positioned between a fixed portion and a movable portion to support the exhaust portion and the grid portion.

According to various embodiments, the supporting portion may include supporting plates disposed to be spaced apart from each other having the fixed portion and the movable portion therebetween, and a supporting frame coupled to the supporting plates to maintain a gap between the supporting plates.

According to various embodiments, the conduction capacity of the DC circuit breaker may be improved. That is, the DC circuit breaker can pass a large amount of DC power. As the first terminals are connected in parallel in the first terminal unit to be connected to the power source and the second terminals are connected in parallel in the second terminal unit to be connected to the load, a large amount of DC power can pass through the DC circuit breaker.

DETAILED DESCRIPTION OF THE INVENTION

Figure 1:
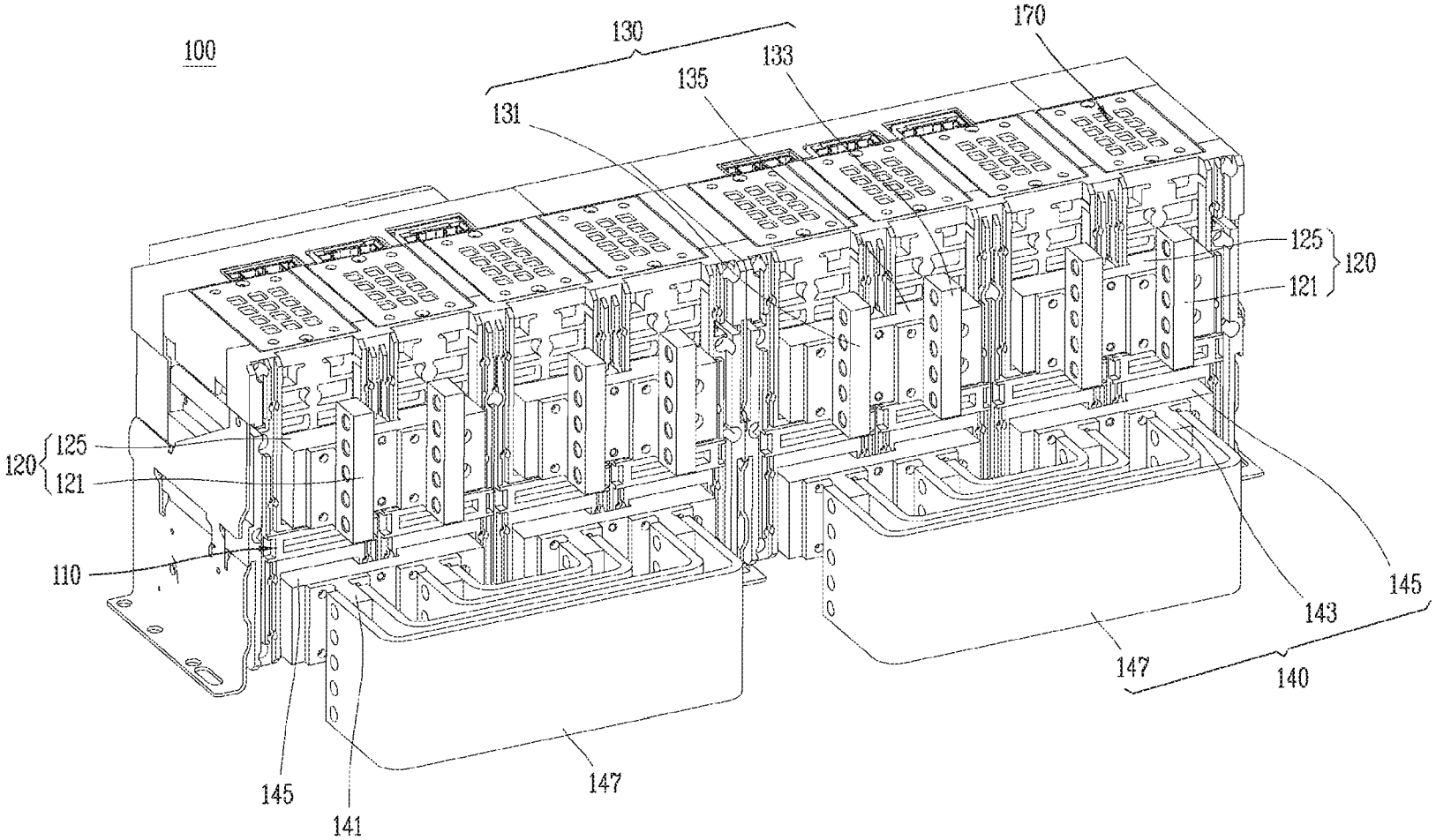
FIG. 1 is a perspective view illustrating a DC circuit breaker according to an embodiment.

Hereinafter, various embodiments of the present disclosure will be described with reference to the accompanying drawings. However, it should be understood that the technology described in this disclosure is not limited to particular embodiments, but should be understood as including various modifications, equivalents, and/or alternatives. In description of the drawings, the same/like reference numerals may be used for the same/like elements.

Terms such as "have", "may have", "includes", or "may include" are used herein and should be understood that they are intended to indicate an existence of a corresponding feature (e.g., a numerical value, function, operation or a component such as a part), and not excluding existence of additional features.

As used herein, the term "first", "second" or the like may be used to denote various components, regardless of order and/or importance, and may be used to distinguish one component from another without limiting the corresponding components.

According to various embodiments, a DC circuit breaker may be installed between a power source and a load to control a connection between the power source and the load. That is, the DC circuit breaker may connect the power source and the load, and may disconnect the power source and the load. At this time, the power source may supply DC power. To this end, the power source may include a positive terminal and a negative terminal. Accordingly, DC power may be supplied from the power source to the load when the power source and the load are connected, and the supply of DC power from the power source to the load may be cut off when the power source and the load are disconnected.

Figure 2:
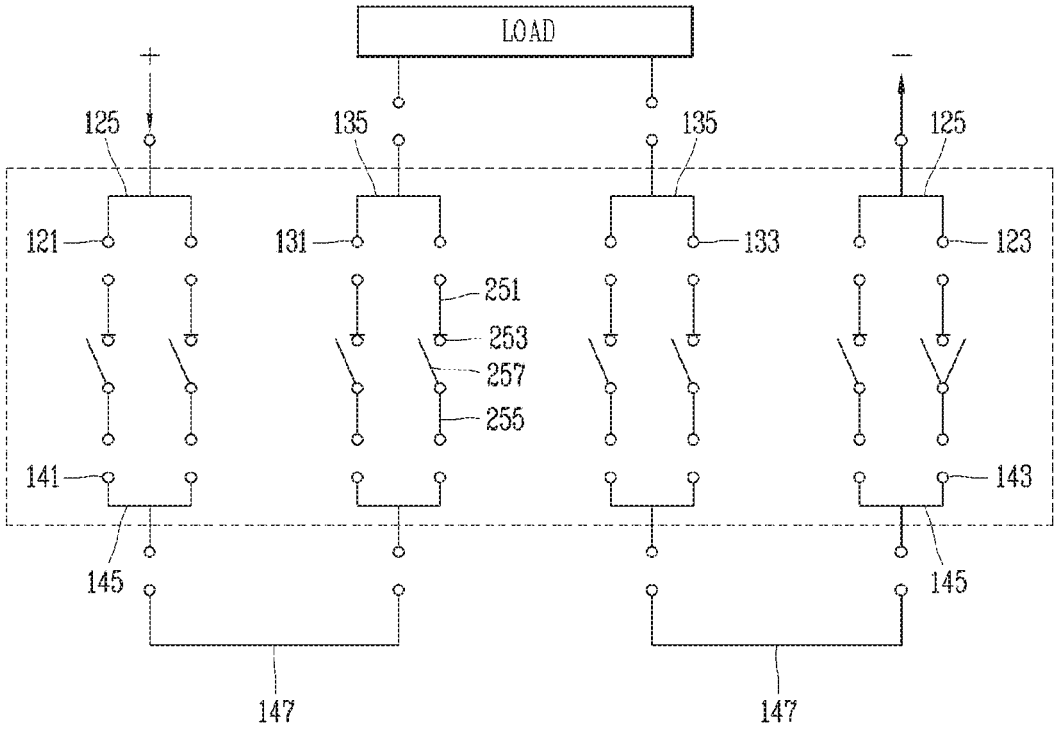
FIG. 2 is a circuit diagram illustrating a connection of terminals in the DC circuit breaker according to an embodiment.
Figure 3:
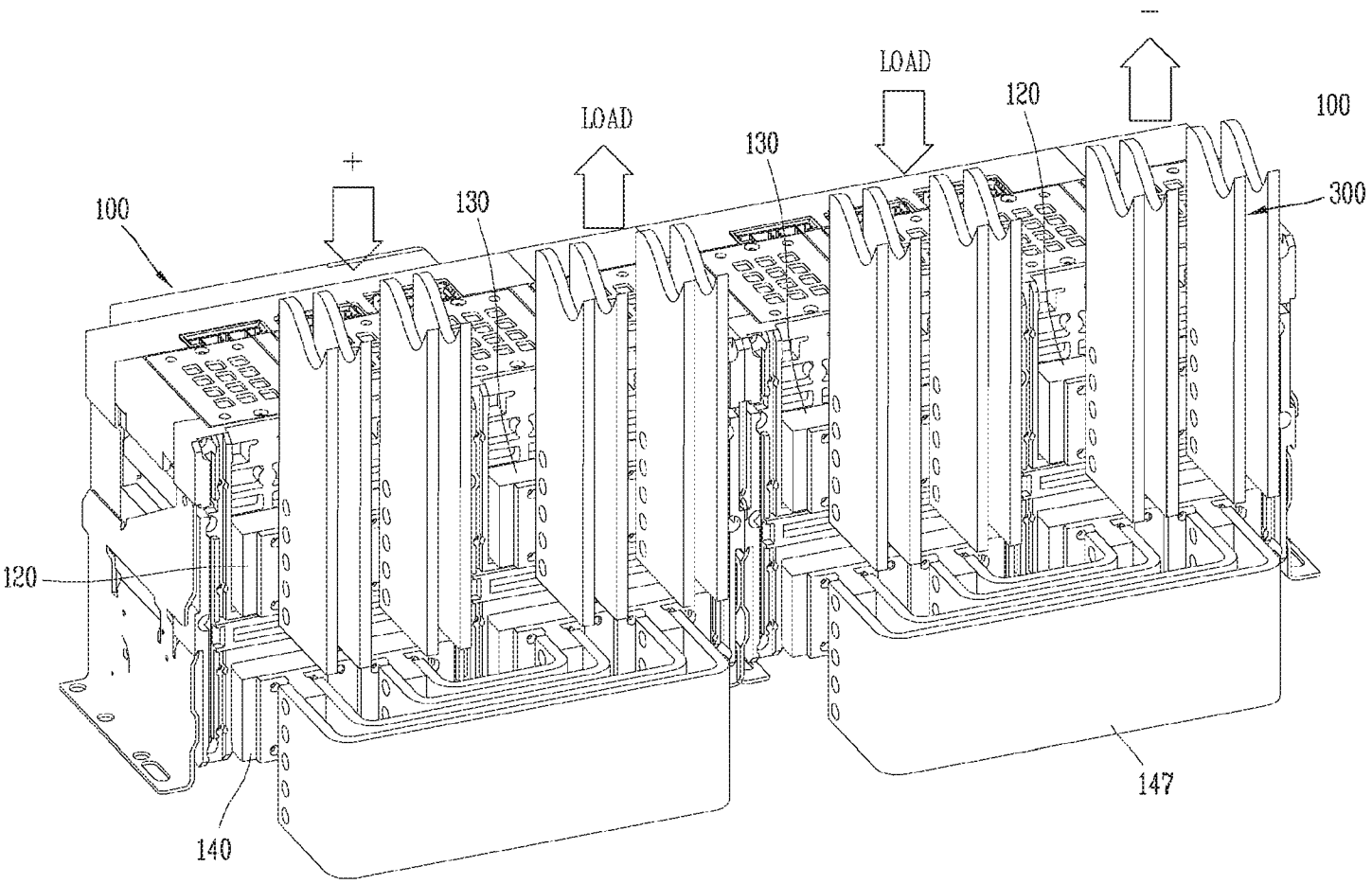
FIG. 3 is a perspective view illustrating a usage of the DC circuit breaker according to an embodiment.

FIG. 1 is a perspective view illustrating a DC circuit breaker 100 according to an embodiment. FIG. 2 is a circuit diagram illustrating a connection of terminals in the DC circuit breaker 100 according to an embodiment. FIG. 3 is a perspective view illustrating a usage of the DC circuit breaker 100 according to an embodiment.

Referring to FIG. 1, the DC circuit breaker 100 according to an embodiment may include a connection portion 110, an opening and closing portion (not illustrated), a mechanical portion (not illustrated), and an arc-extinguishing portion 170.

The connection portion 110 may be provided for external connection of the DC circuit breaker 100. To this end, the connection portion 110 may be exposed to an outside of the DC circuit breaker 100. The connection portion 110 may include a first terminal unit 120, a second terminal unit 130, and a third terminal unit 140. Here, the first terminal unit 120 and the second terminal unit 130 may be arranged in a same column, and the third terminal unit 140 may be arranged in a column different from the first terminal unit 120 and the second terminal unit 130. Here, the first terminal unit 120 and the second terminal unit 130 may be disposed on a portion upper than the third terminal unit 140, and the third terminal unit 140 may be disposed on a portion lower than the first terminal unit 120 and the second terminal unit 130.

The first terminal unit 120 may be connected to the power source. The first terminal unit 120 may include a plurality of first terminals 121 and 123 and at least one first connection portion 125. The first connection portion 125 may connect the first terminals 121 and 123 in at least one pair. For example, the first terminal unit 120 may be represented as illustrated in FIG. 2.

The first terminals 121 and 123 may include a pair of first positive terminals 121 and a pair of first negative terminals 123. The first connection portion 125 may connect the first positive terminals 121 in parallel to each other and the first negative terminals 123 in parallel to each other. Accordingly, the first positive terminals 121 may be connected to a positive terminal of the power source with being connected to each other in parallel, and the first negative terminals 123 may be connected to a negative terminal of the power source with being connected to each other in parallel.

The second terminal unit 130 may be connected to the load. The second terminal unit 130 may include a plurality of second terminals 131 and 133 and at least one second connection portion 135. The second connection portion 135 may connect the second terminals 131 and 133 in at least one pair. For example, the second terminal unit 130 may be represented as illustrated in FIG. 2.

The second terminals 131 and 133 may include a pair of second positive terminals 131 and a pair of second negative terminals 133. Here, the second positive terminals 131 may correspond to the first positive terminals 121, respectively, and the second negative terminals 133 may correspond to the first negative terminals 123, respectively. The second connection portion 135 may connect the second positive terminals 131 in parallel to each other and the second negative terminals 133 in parallel to each other. Accordingly, the second positive terminals 131 may be connected to the load with being connected to each other in parallel, and the second negative terminals 133 may be connected to the load with being connected to each other in parallel.

The third terminal unit 140 may connect the first terminal unit 120 and the second terminal unit 130. The third terminal unit 140 may include a plurality of third terminals 141 and 143, a plurality of third connection portions 145, and at least one fourth connection portion 147. The third connection portions 145 may connect the third terminals 141 and 143 in a plurality of pairs to configure a plurality of groups. The fourth connection portion 147 may connect groups of the third terminals 141 and 143 in at least one pair. For example, the third terminal unit 140 may be represented as illustrated in FIG. 2.

The third terminals 141 and 143 may include two pairs of third positive terminals 141 and two pairs of third negative terminals 143. Here, the third positive terminals 141 may be connected to the first positive terminals 121 and the second positive terminals 131, respectively, and the third negative terminals 143 may be connected to the first negative terminals 123 and the second negative terminals 133, respectively. The third connection portions 145 may connect the third positive terminals 141 in parallel to each other to form two groups, and may connect the third negative terminals 143 in parallel to each other to form two groups. The fourth connection portion 147 may connect groups of the third positive terminals 141 in parallel to each other, and connect groups of the third negative terminals 143 in parallel to each other. Accordingly, the third terminal unit 140 may connect the first positive terminals 121 and the second positive terminals 131, and connect the first negative terminals 123 and the second negative terminals 133.

The opening and closing portion may control the connection between the first terminal unit 120 and the second terminal unit 130 in the DC circuit breaker 100. To this end, the opening and closing portion may control the connection between the first terminal unit 120 and the third terminal unit 140, and the connection between the second terminal unit 130 and the third terminal unit 140. That is, the opening and closing portion may connect or disconnect the first terminal unit 120, the second terminal unit 130, and the third terminal unit 140. The opening and closing portion may include a fixed portion 251 and a movable portion 255 as illustrated in FIG. 2. The fixed portion 251 may be fixed at a predetermined position in the DC circuit breaker 100, and may include a plurality of fixed contacts 253. The movable portion 255 is movable against the fixed portion 251 in the DC circuit breaker 100 so as to be contacted to the fixed portion 251 or to be disconnected from the fixed portion 251, and may include a plurality of movable contacts 257. Accordingly, when the fixed portion 251 and the movable portion 255 are in contact, the first terminal unit 120, the second terminal unit 130 and the third terminal unit 140 may be connected. And, when the fixed portion 251 and the movable portion 255 are disconnected, the first terminal unit 120, the second terminal unit 130 and the third terminal unit 140 may be disconnected.

At this time, as illustrated in FIG. 2, the fixed portion 251 may be connected to the first terminal unit 120 and the second terminal unit 130, and the movable portion 255 may be connected to the third terminal unit 140. Here, the fixed contacts 253 may be connected to the first terminals 121 and 123 and the second terminals 131 and 133, respectively, and the movable contacts 257 may be connected to the third terminals 141 and 143, respectively. Alternatively, although not illustrated, the movable portion 255 may be connected to the first terminal unit 120 and the second terminal unit 130, and the fixed portion 251 may be connected to the third terminal unit 140. Here, the movable contacts 257 may be connected to the first terminals 121 and 123 and the second terminals 131 and 133, respectively, and the fixed contacts 253 may be connected to the third terminals 141 and 143, respectively.

The mechanism portion may control an operation of the opening and closing portion in the DC circuit breaker 100. The mechanism portion may control the movable portion 255 to make the movable portion 255 contact the fixed portion 251, or disconnect the movable portion 255 from the fixed portion 251. At this time, the mechanism portion may disconnect the movable portion 255 from the fixed portion 251 in response to an abnormal current such as an overcurrent or a short-circuit current.

The arc-extinguishing portion 170 may extinguish an arc generated in the DC circuit breaker 100. As the fixed portion 251 and the movable portion 255 that are in contact with the opening and closing portion are disconnected from each other, an arc may be generated between the fixed portion 251 and the movable portion 255. Accordingly, the arc can be extinguished by disposing the arc-extinguishing portion 170 adjacent to the opening and closing portion. For example, the arc-extinguishing portion 170 may be disposed on an upper portion of the opening and closing portion. In addition, the arc-extinguishing portion 170 may extinguish the arc by using air as a medium.

According to one embodiment, the DC circuit breaker 100 may be installed in a predetermined place and used therein. To this end, as illustrated in FIG. 3, an installation guide portion 300 may be coupled to the DC circuit breaker 100. At this time, the installation guide portion 300 may be coupled to the first terminal unit 120 and the second terminal unit 130. In addition, the installation guide portion 300 may be connected to the power source and the load. That is, the first terminal unit 120 and the second terminal unit 130 may be connected to the power source and the load, respectively, through the installation guide portion 300.

According to one embodiment, the DC circuit breaker 100 may pass a large amount of DC power. That is, as the first terminals 121 and 123 are connected in parallel to the power source in the first terminal unit 120, and the second terminals 131 and 133 are connected in parallel to the load in the second terminal portion 130, a large amount of DC power can pass through the DC circuit breaker 100. However, a size of the DC circuit breaker 100 may be relatively large. This is because, the third terminal unit 140 as well as the opening and closing portion and the mechanism portion should be configured in order to connect the first terminal unit 120 and the second terminal unit 130. Accordingly, an excessively large space may be required to install the DC circuit breaker 100. In addition, a design for arranging the installation guide portion 300 may be complicating.

Figure 4:
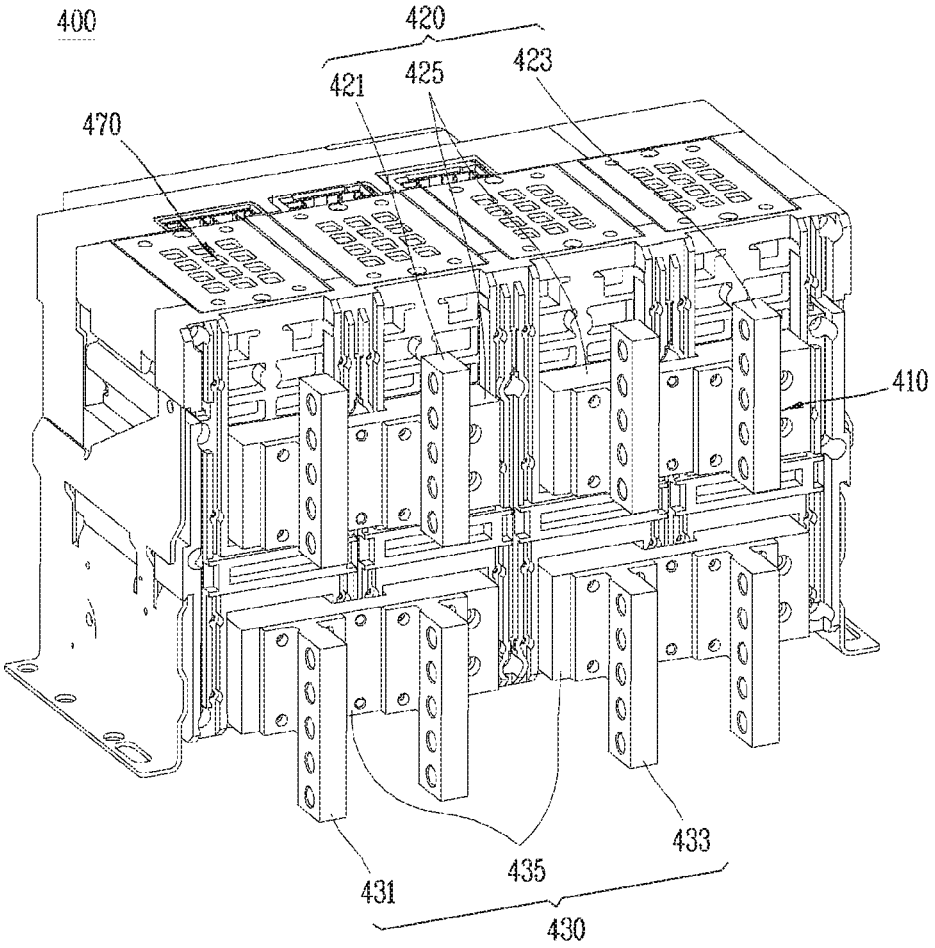
FIG. 4 is a perspective view illustrating a DC circuit breaker according to another embodiment.
Figure 5:
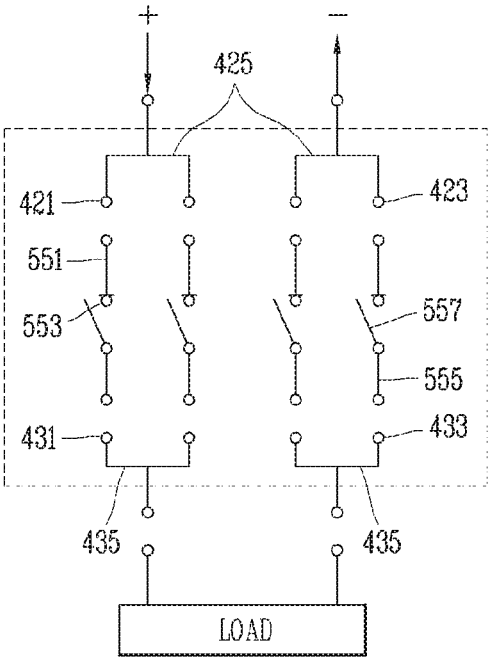
FIG. 5 is a circuit diagram illustrating a connection of terminals in the DC circuit breaker according to another embodiment.
Figure 6:
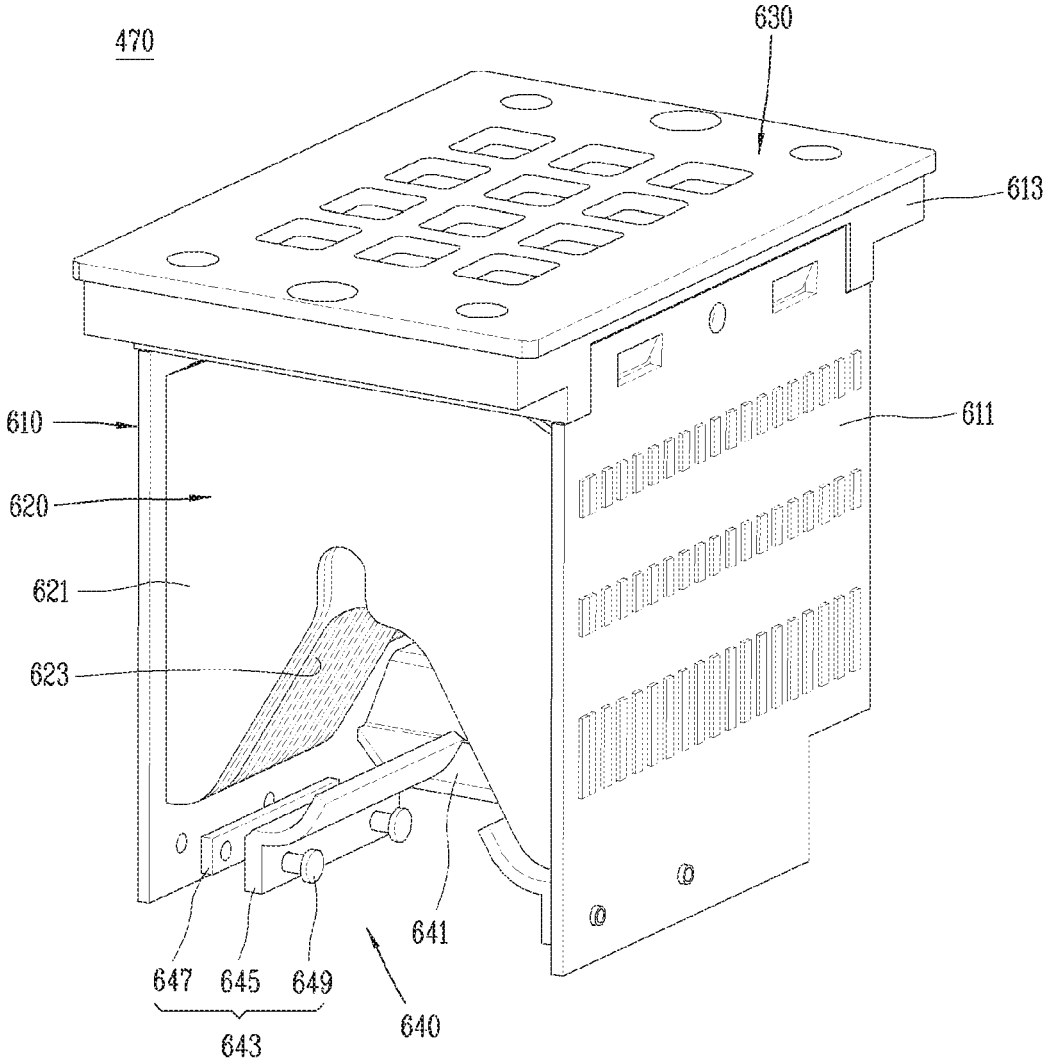
FIG. 6 is a perspective view illustrating an arc-extinguishing portion of the DC circuit breaker according to another embodiment.
Figure 7:
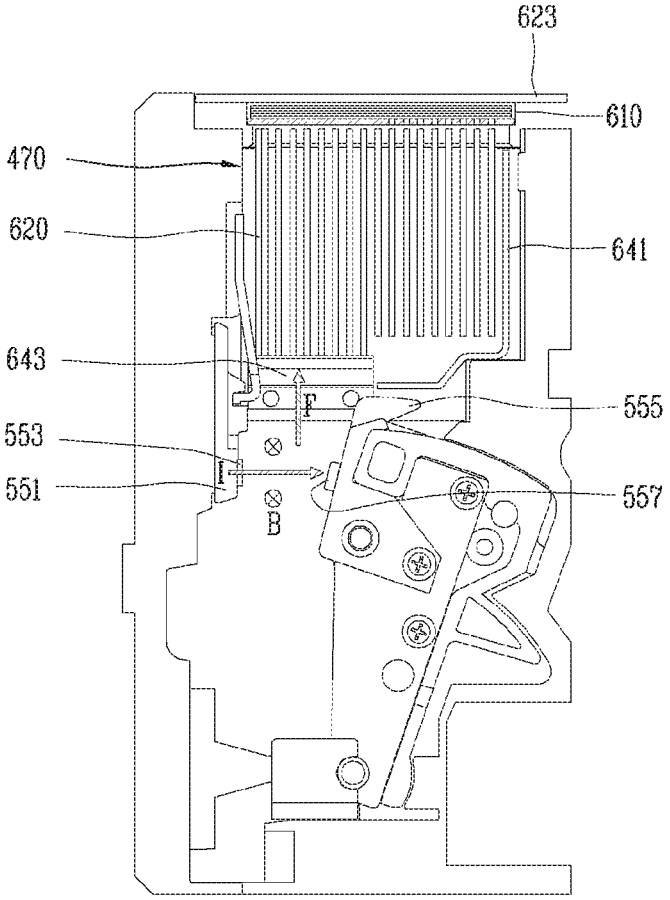
FIG. 7 is a side cross-sectional view illustrating an operation of the arc-extinguishing portion in the DC circuit breaker according to another embodiment.
Figure 8:
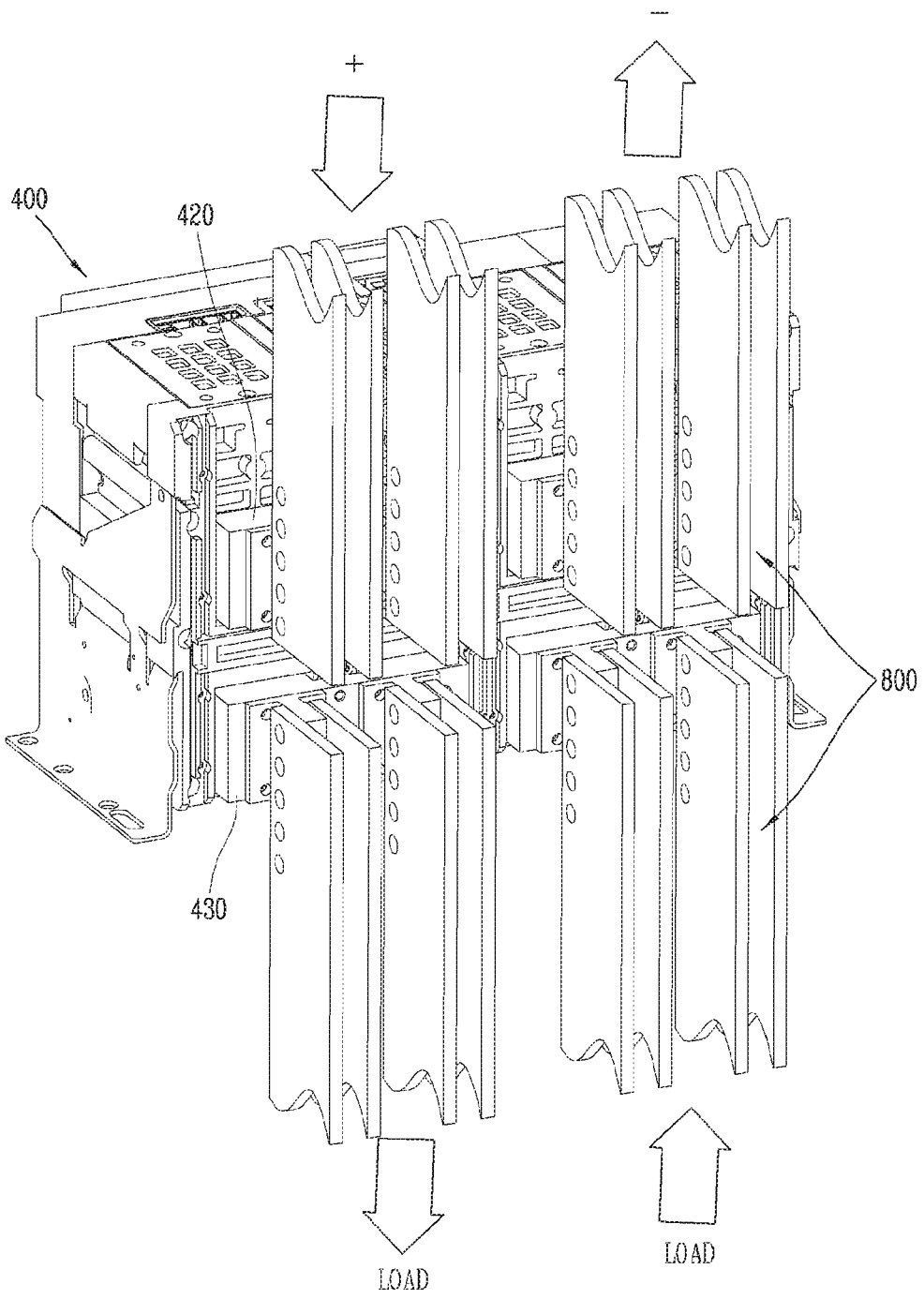
FIG. 8 is a perspective view illustrating a usage of the DC circuit breaker according to another embodiment.

FIG. 4 is a perspective view illustrating a DC circuit breaker 400 according to another embodiment. FIG. 5 is a circuit diagram illustrating a connection of terminals in the DC circuit breaker 400 according to another embodiment. FIG. 6 is a perspective view illustrating an arc-extinguishing portion 470 of the DC circuit breaker 400 according to another embodiment. FIG. 7 is a side cross-sectional view illustrating an operation of the arc-extinguishing portion 470 in the DC circuit breaker 400 according to another embodiment. FIG. 8 is a perspective view illustrating a usage of the DC circuit breaker 400 according to another embodiment.

Referring to FIG. 4, the DC circuit breaker 400 according to another embodiment may include a connection portion 410, an opening and closing portion (not illustrated), a mechanical portion (not illustrated), and an arc-extinguishing portion 470.

The connection portion 410 may be provided for external connection of the DC circuit breaker 400. To this end, the connection portion 410 may be exposed to an outside of the DC circuit breaker 400. The connection portion 410 may connect a first terminal unit 420 and a second terminal unit 430. Here, the first terminal unit 420 and the second terminal unit 430 may be arranged in different columns. Here, the first terminal unit 420 and the second terminal unit 430 may be arranged vertically. For example, the first terminal unit 420 may be disposed above the second terminal unit 430, and the second terminal unit 430 may be disposed below the first terminal unit 420. Or, the first terminal unit 420 may be disposed below the second terminal unit 430, and the second terminal unit 430 may be disposed above the first terminal unit 420.

The first terminal unit 420 may be connected to a power source. The first terminal unit 420 may include a plurality of first terminals 421 and 423 and a first connection portion 425. The first connection portion 425 may connect the first terminals 421 and 423 in at least one pair. For example, the first terminal unit 420 may be represented as illustrated in FIG. 5.

The first terminals 421 and 423 may include a pair of first positive terminals 421 and a pair of first negative terminals 423. The first connection portion 425 may connect the first positive terminals 421 in parallel to each other and the first negative terminals 423 in parallel to each other. Accordingly, the first positive terminals 421 may be connected to a positive terminal of the power source with being connected to each other in parallel, and the first negative terminals 423 may be connected to a negative terminal of the power source with being connected to each other in parallel.

The second terminal unit 430 may be connected to a load. The second terminal unit 430 may include a plurality of second terminals 431 and 433 and a second connection portion 435. The second connection portion 435 may connect the second terminals 431 and 433 in at least one pair. For example, the second terminal unit 430 may be represented as illustrated in FIG. 5.

The second terminals 431 and 433 may include a pair of second positive terminals 431 and a pair of second negative terminals 433. Here, the second positive terminals 431 may correspond to the first positive terminals 421, respectively, and the second negative terminals 433 may correspond to the first negative terminals 423, respectively. The second connection portion 435 may connect the second positive terminals 431 in parallel to each other and the second negative terminals 433 in parallel to each other. Accordingly, the second positive terminals 431 may be connected to the load with being connected to each other in parallel, and the second negative terminals 433 may be connected to the load with being connected to each other in parallel.

According to another embodiment, the first terminal unit 420 and the second terminal unit 430 may be connected. For example, the first terminal unit 420 and the second terminal unit 430 may correspond to each other as illustrated in FIG. 5. The first positive terminals 421 and the second positive terminals 431 may respectively correspond, and the first negative terminals 423 and the second negative terminals 433 may respectively correspond.

The opening and closing portion may control the connection between the first terminal unit 420 and the second terminal unit 430 in the DC circuit breaker 400. That is, the opening and closing portion may connect or disconnect the first terminal unit 420 and the second terminal unit 430. The opening and closing portion may include a fixed portion 551 and a movable portion 555 as illustrated in FIG. 5. The fixed portion 551 may be fixed at a predetermined position in the DC circuit breaker 400, and may include a plurality of fixed contacts 553. The movable portion 555 is movable against the fixed portion 551 in the DC circuit breaker 400 so as to contact the fixed portion 551 or to be disconnected from the fixed portion 551, and may include a plurality of movable contacts 557. Accordingly, when the fixed portion 551 and the movable portion 555 are in contact, the first terminal unit 420 and the second terminal unit 430 may be connected. And, when the fixed portion 551 and the movable portion 555 are disconnected, the first terminal unit 420 and the second terminal unit 430 may be disconnected.

At this time, as illustrated in FIG. 5, the fixed portion 551 may be connected to the first terminal unit 420, and the movable portion 555 may be connected to the second terminal unit 430. Here, the fixed contacts 553 may be connected to the first terminals 421 and 423, respectively, and the movable contacts 557 may be connected to the second terminals 431 and 433, respectively. Alternatively, although not illustrated, the movable portion 555 may be connected to the first terminal unit 420 and the fixed portion 551 may be connected to the second terminal unit 430. Here, the movable contacts 557 may be connected to the first terminals 421 and 423, respectively, and the fixed contacts 553 may be connected to the second terminals 431 and 433, respectively.

The mechanism portion may control an operation of the opening and closing portion in the DC circuit breaker 400. The mechanism portion may control the movable portion 555 to make the movable portion 555 contact the fixed portion 551, or disconnect the movable portion 555 from the fixed portion 551. At this time, the mechanism portion may disconnect the movable portion 555 from the fixed portion 551 in response to an abnormal current such as an overcurrent or a short-circuit current.

The arc-extinguishing portion 470 may extinguish an arc generated in the DC circuit breaker 400. As the fixed portion 551 and the movable portion 555 that are in contact with the opening and closing portion are disconnected from each other, an arc may be generated between the fixed portion 551 and the movable portion 555. Accordingly, the arc can be extinguished by disposing the arc-extinguishing portion 470 adjacent to the opening and closing portion. For example, the arc-extinguishing portion 470 may be disposed on an upper portion of the opening and closing portion. In addition, the arc-extinguishing portion 470 may extinguish the arc by using air as a medium. The arc-extinguishing portion 470 may include a supporting portion 610, a grid portion 620, an exhaust portion 630, and an induction portion 640 as illustrated in FIGS. 6 and 7.

The supporting portion 610 may support the grid portion 620, the exhaust portion 630, and the induction portion 640. The supporting portion 610 may include supporting plates 611 and a supporting frame 613. The supporting plates 611 may be arranged side by side to each other. Here, the supporting plates 611 may be spaced apart from each other with the fixed portion 551 and the movable portion 555 therebetween inside the DC circuit breaker 400. For example, the supporting plates 611 may be made of a metal material. The supporting frame 613 may be coupled to the supporting plates 611. Here, the supporting frame 613 may maintain spacings of the supporting plates 611. Here, the supporting frame 613 may be coupled to upper portions of the supporting plates 611.

The grid portion 620 may substantially extinguish an arc. The grid portion 620 may include a plurality of grids 621. The grids 621 may be arranged between the supporting plates 611, side by side with each other. To this end, the grids 621 may be defined in a plate shape, and made of a metal material. Here, the grids 621 may be arranged at predetermined intervals. Here, the grids 621 may be arranged along a direction perpendicular to a direction in which the supporting plates 611 are arranged. And, the grids 621 may be coupled to the supporting plates 611. To this end, the grids 621 may pass through the supporting plates 611 to be fixed to the supporting plates 611. Accordingly, the grid portion 620 may face the fixed portion 551 and the movable portion 555 and be exposed downward. When an arc generated from the fixed portion 551 and the movable portion 555 is introduced, the grids 621 may increase a pressure of the arc and divide the arc to cool it.

For example, each grid 621 may include a slit portion 623. Here, a width of the slit portion 623 may be narrower as each grid 621 goes from a lower portion to an upper portion. Here, the slit portion 623 may be defined in a symmetrical shape centering on an axis passing through from the lower portion to the upper portion in each grid 621, but is not limited thereto.

The exhaust portion 630 may exhaust the arc. The exhaust portion 630 may cover the grid portion 620 from the top. To this end, the exhaust portion 630 may be coupled to the supporting frame 613. Accordingly, the exhaust portion 630 may exhaust the arc cooled in the grid portion 620.

The induction portion 640 may induce an arc to the grid portion 620. The induction portion 640 may include an arc runner 641 and arc guide portions 643. The arc runner 641 extends from the fixed portion 551 and the movable portion 555 to the grid portion 620 to provide a movement path of the arc. Here, the arc runner 641 may cover at least a part of the grid portion 620 between the supporting plates 611. For example, the arc runner 641 may include at least one of a curved surface or a flat surface, and may be made of a metal material. The arc guide portions 643 may be disposed between the supporting plates 611 to face each other. To this end, the arc guide portions 643 may be respectively coupled to the supporting plates 611 at a lower portion of the grid portion 620. Each arc guide portion 643 may include a path portion 645, a magnetic portion 647, and a coupling portion 649.

The path portion 645 may face the grid portion 620 to provide a movement path of the arc. Here, the path portion 645 may guide the arc to a central part of the grid portion 620. For example, the path portion 645 may include at least one of a curved surface or a flat surface, and may be made of a metal material.

The magnetic portion 647 may be mounted between any one of the supporting plates 611 and the path portion 645. The magnetic portion 647 may form a magnetic field B between the supporting plates 611. To this end, the magnetic portion 647 may be an N-pole in any one of the arc guide portions 643, and the magnetic portion 647 may be an S-pole in another of the arc guide portions 643. At this time, as illustrated in FIG. 7, when a current I according to the arc flows from the fixed contact 553 to the movable contact 557, N-pole and S-pole may be disposed based on Fleming's left-hand law so that a force F is generated from the fixed contact 553 and the movable contact 557 toward the grid portion 620. Accordingly, the arc may be transferred by the force generated from the fixed contact 553 and the movable contact 557 toward the grid portion 620.

The coupling portion 649 may mount the path portion 645 and the magnetic portion 647 to any one of the supporting plates 611. At this time, the coupling portion 649 may pass through any one of the path portion 645, the magnetic portion 647, and the supporting plates 611, and be fixed to any one of the supporting plates 611.

According to another embodiment, the DC circuit breaker 400 may be installed in a predetermined place and used therein. To this end, as illustrated in FIG. 8, an installation guide portion 800 may be coupled to the DC circuit breaker 400. At this time, the installation guide portion 800 may be coupled to the first terminal unit 420 and the second terminal unit 430. In addition, the installation guide portion 800 may be connected to the power source and the load. That is, the first terminal unit 420 and the second terminal unit 430 may be connected to the power source and the load, respectively, through the installation guide portion 800.

According to another embodiment, the DC circuit breaker 400 may pass a large amount of DC power. That is, as the first terminals 421 and 423 are connected in parallel to the power source in the first terminal unit 420, and the second terminals 431 and 433 are connected in parallel to the load in the second terminal portion 430, a large amount of DC power can pass through the DC circuit breaker 400. At this time, even if an arc is generated due to a large amount of DC power between the fixed portion 551 and the movable portion 555, the arc extinguishing portion 470 can effectively extinguish the arc. That is, the arc guide portions 643 generate a force from the fixed portion 551 and the movable portion 555 to the grid portion 620 to effectively transfer the arc, thereby extinguishing the arc in the grid portion 620. In addition, a size of the DC circuit breaker 400 can be reduced. This is because, in connecting the first terminal unit 420 and the second terminal unit 430, a configuration to be interposed between the first terminal unit 420 and the second terminal unit 430 is reduced. This may result in reducing a space for installing the DC circuit breaker 400. Accordingly, a design for arranging the installation guide portion 800 can also be simplified.

The terminology used herein is for the purpose of describing specific embodiments only and is not intended to limit the scope of the other embodiments. A singular representation may include a plural representation unless it represents a definitely different meaning from the context. Terms used herein, including technical or scientific terms, may have the same meaning as commonly understood by one of ordinary skill in the art to which the present invention belongs. Terms defined in the general dictionary of terms used herein may be construed as the same or similar meaning as that in the context of the related technology, and should not be construed too ideally or excessively, unless otherwise clearly defined in this document. In some cases, even the terms defined in this document cannot be construed to exclude the embodiments of this document.

The invention claimed is:

1. A DC circuit breaker comprising:

a first terminal unit connected to a power source;

a second terminal unit connected to the first terminal unit and connected to a load, wherein the first terminal unit comprises at least a pair of first terminals connected to each other in parallel and connected to the power source, wherein the second terminal unit comprises at least a pair of second terminals respectively corresponding to the first terminals and connected to each other in parallel so as to be connected to the load, wherein the first terminals comprise:

a pair of first positive terminals configured to be connected to a positive electrode of the power source; and a pair of first negative terminals configured to be connected to a negative electrode of the power source, wherein the second terminals comprise:

a pair of second positive terminals respectively corresponding to the first positive terminals; and a pair of second negative terminals respectively corresponding to the first negative terminals; and a third terminal unit arranged in a column different from the first terminal unit and the second terminal unit, the third terminal unit connecting the first terminal unit and the second terminal unit, wherein the third terminal unit includes two pairs of third positive terminals and two pairs of third negative terminals, wherein a pair of third positive terminals is connected to the pair of first positive terminals and another pair of third positive terminals is connected to the pair of second positive terminals, wherein a pair of third negative terminals is connected to the pair of first negative terminals and another pair of third negative terminals is connected to the pair of second negative terminals.

2. The DC circuit breaker of claim 1, wherein the first terminal unit further comprises a first connection portion configured to connect the first terminals in parallel.

3. The DC circuit breaker of claim 1, wherein the second terminal unit further comprises a second connection portion configured to connect the second terminals in parallel.

4. The DC circuit breaker of claim 1, further comprising:

an opening and closing portion configured to control a connection between the first terminal unit and the second terminal unit.

5. The DC circuit breaker of claim 4, further comprising:

an arc-extinguishing portion configured to extinguish an arc generated by an operation of the opening and closing portion.

6. The DC circuit breaker of claim 5, wherein the arc-extinguishing portion comprises:

an induction portion configured to guide the arc generated by the operation of the opening and closing portion to a grid portion;

the grid portion configured to increase a pressure of the arc induced by the induction portion; and an exhaust portion configured to discharge the arc having the increased pressure through the grid portion.

7. The DC circuit breaker of claim 6, further comprising:

a supporting portion positioned between a fixed portion and a movable portion to support the exhaust portion and the grid portion.

8. The DC circuit breaker of claim 7, wherein the supporting portion comprises:

supporting plates disposed to be spaced apart from each other having the fixed portion and the movable portion therebetween; and a supporting frame coupled to the supporting plates to maintain a gap between the supporting plates.

* * * * *